US007221344B2

(12) United States Patent
Shimomaki

(10) Patent No.: US 7,221,344 B2
(45) Date of Patent: May 22, 2007

(54) LIQUID CRYSTAL DISPLAY DEVICE AND DRIVING CONTROL METHOD THEREOF

(75) Inventor: Shinichi Shimomaki, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 423 days.

(21) Appl. No.: 10/007,468

(22) Filed: Nov. 7, 2001

(65) Prior Publication Data

US 2002/0057243 A1 May 16, 2002

(30) Foreign Application Priority Data

Nov. 10, 2000 (JP) ..... 2000-343926

(51) Int. Cl.
*G09G 3/36* (2006.01)

(52) U.S. Cl. ..... 345/87; 345/209; 345/210; 345/214; 345/215; 345/92; 345/94

(58) Field of Classification Search ..... 345/94–96, 345/209–215, 87, 92; 349/42–47
See application file for complete search history.

(56) References Cited

U.S. PATENT DOCUMENTS

| | | | | | |
|---|---|---|---|---|---|
| 5,117,298 | A | * | 5/1992 | Hirai | 345/96 |
| 5,490,000 | A | * | 2/1996 | Tanaka et al. | 349/33 |
| 5,510,807 | A | * | 4/1996 | Lee et al. | 345/103 |
| 5,561,381 | A | * | 10/1996 | Jenkins et al. | 324/678 |
| 5,598,177 | A | * | 1/1997 | Mizukata et al. | 345/92 |
| 5,706,023 | A | * | 1/1998 | Nagata et al. | 345/92 |
| 5,790,089 | A | * | 8/1998 | Ono et al. | 345/94 |
| 5,825,343 | A | * | 10/1998 | Moon | 345/94 |
| 5,895,108 | A | * | 4/1999 | Tanaka | 349/173 |
| 5,920,298 | A | | 7/1999 | McKnight | |
| 5,995,074 | A | * | 11/1999 | Kusafuka et al. | 345/90 |
| 6,005,542 | A | * | 12/1999 | Yoon | 345/92 |
| 6,078,303 | A | * | 6/2000 | McKnight | 345/87 |
| 6,362,803 | B1 | * | 3/2002 | Tomomura et al. | 345/94 |
| 6,486,864 | B1 | * | 11/2002 | Nakajima et al. | 345/92 |
| 6,549,187 | B1 | * | 4/2003 | Matsubara et al. | 345/96 |
| 6,590,552 | B1 | * | 7/2003 | Yokoyama et al. | 345/92 |
| 6,825,823 | B1 | * | 11/2004 | Taira et al. | 345/88 |

FOREIGN PATENT DOCUMENTS

| | | | | |
|---|---|---|---|---|
| CN | 1159599 A | | 9/1997 | |
| JP | 406175101 A | * | 6/1994 | 345/92 |
| JP | 9-138421 | | 5/1997 | |
| JP | 11-502325 | | 2/1999 | |
| JP | 11-109921 | | 4/1999 | |
| JP | 2000-56334 | | 12/2000 | |

* cited by examiner

OTHER PUBLICATIONS

Japanese Official Action (Decision of Rejection) mailed Apr. 13, 2006 in counterpart Japanese Application with English language translation.

*Primary Examiner*—Richard Hjerpe
*Assistant Examiner*—Leonid Shapiro
(74) *Attorney, Agent, or Firm*—Frishauf, Holtz, Goodman & Chick, P.C.

(57) ABSTRACT

In a liquid crystal display device of an active matrix type, at first, an initialization signal voltage having a voltage value equal to or higher than the maximum voltage value of a display signal is applied to display pixels in a signal application period in a field period. The display signal is thereafter applied. As a result, the change amount of the voltage applied to liquid crystal due to the field-through voltage in relation to a gate pulse can be arranged to be substantially constant, and can always be cancelled by a common electrode voltage. Occurrence of flicker and seizure phenomena can be thereby restricted so that the display quality can be improved.

15 Claims, 10 Drawing Sheets

RESPONSE SPEED TO LIQUID CRYSTAL CELL GAP
(MEASURED VALUES)

| CELL GAP | RISING RESPONSE TIME | FALLING RESPONSE TIME |
|---|---|---|
| 4.8 μm | 5.85ms | 26.03msec |
| 1.5 μm | 0.73ms | 5.5msec |

FIG.4

1 FRAME PERIOD
n-th FIELD
(n+1)-th FIELD
1st SUB-FIELD (R)
2nd SUB-FIELD (G)
3rd SUB-FIELD (B)
1st SUB-FIELD (R)
2nd SUB-FIELD (G)
3rd SUB-FIELD (B)

(1st SCANNING LINE)
P5
ΔV1
P6
P7
ΔV2
P8
P9
P10
VMAX
VCOM
VSIG
VP3
VG
ΔVG
TPR1
TPG1
TPB1

(2nd SCANNING LINE)
TPR2
TPG2
TPB2

(3rd SCANNING LINE)

R
G
B
ON
OFF

LIQUID CRYSTAL DISPLAY DEVICE AND DRIVING CONTROL METHOD THEREOF

CROSS-REFERENCE TO RELATED APPLICATIONS

This application is based upon and claims the benefit of priority from the prior Japanese Patent Application No. 2000-343926, filed Nov. 10, 2000, the entire contents of which are incorporated herein by reference.

BACKGROUND OF THE INVENTION

1. Field of the Invention

The present invention relates to a liquid crystal display device and a driving control method thereof, and particularly to a liquid crystal display device of an active matrix type which uses a plurality of thin-film transistors as switching elements, and a driving control method thereof.

2. Description of the Related Art

In recent years, liquid crystal display devices (LCD) for displaying images, text information, and the like are mounted on image pickup apparatuses represented by digital video cameras, digital still cameras, and the like, portable phones, and personal digital assistants (PDA). Further, in place of conventional cathode ray tubes (CRTs), liquid crystal display devices have come to be often used as monitors and displays of information terminals of computers and video apparatuses.

A conventional liquid crystal display device will be explained with reference to the drawings. As an example of the liquid crystal display device, explanation will now be made of the structure of a main part of a liquid crystal display device of an active matrix type.

FIG. 8A is a diagram showing an example of an equivalent circuit of a liquid crystal display panel of a conventional active matrix type. FIG. 8B shows the details of a display pixel part in the liquid crystal display panel of the conventional active matrix type. In this case, explanation will be made of the case of using thin film transistors as switching elements.

As shown in the figures, the active matrix type liquid crystal display panel 100 comprises a plurality of signal lines DL extended in the row direction, a plurality of scanning lines GL extended in the column direction, thin film transistors (hereinafter described as pixel transistors TFT) provided respectively near the cross-points between the signal lines DL and the scanning lines GL, pixel electrodes connected to source electrodes S of the pixel transistors TFT and arrayed in a matrix, common electrodes COM opposed to the pixel electrodes and connected in common, liquid crystal capacitances CLC filled between the pixel electrodes and the common electrodes COM, auxiliary capacitor electrodes ES connected in common and forming part of auxiliary capacitances CS opposed to the pixel electrodes to maintain display signal voltages applied to the pixel electrodes. The pixel transistor TFT has a drain electrode D connected to the signal line DL and a gate electrode G connected to the scanning line GL. The liquid crystal capacitances CLC and the auxiliary capacitances CS serve as display pixels and are driven and controlled by the pixel transistors TFT.

FIG. 9 is a timing chart showing write operation of display signal voltages of the conventional active matrix type liquid crystal display panel to the display pixels. FIG. 9 shows a case of writing a display signal voltage into a display pixel by a field inversion drive system. Normally, it is driven at 30 frames per second, and one frame period is about 33.3 ms. In the field inversion drive system, one screen is over-written for every field of ½ frame period (about 16.7 ms), and the polarity of the display signal voltage is inverted for every one field. FIG. 9 shows a case where the voltage Vcom applied to the common electrode COM and the auxiliary capacitor electrode ES is constant. Needless to say, this voltage Vcom may be controlled to be inverted in correspondence with inversion of the display signal voltage.

As shown in FIG. 9, a display signal voltage which is set to invert its polarity with respect to a predetermined center voltage Vsigc for every field, in correspondence with a video signal is supplied to each signal line DL and is thus applied to the drain electrodes D of the pixel transistors TFT. In FIG. 9, the display signal voltage Vsig of a positive polarity is applied in the n-th field, and a display signal voltage Vsig of a negative polarity is applied in the (n+1)-th field.

Meanwhile, at predetermined timing during the period of applying the display signal voltage Vsig, a scanning signal Vg is supplied to each scanning line GL of the liquid crystal display panel 100 only for a predetermined write time Tw and is applied to the gate electrodes G of the pixel transistors TFT. In this manner, the pixel transistors TFT are turned into ON-status, so that the drain electrodes D and the source electrodes S are conducted to each other, respectively, thereby to apply a display signal voltage Vsig to the pixel electrodes. The potential difference between the display signal voltage Vsig applied to the pixel electrodes and the voltage Vcom applied to the common electrodes is a liquid crystal application voltage Vp. This voltage is applied to the liquid crystal molecules filled between the pixel electrodes and the opposite electrodes, their orientation status is changed to light permeability, thereby to change the image. Applied charges are maintained until the write timing in the next field, by the liquid crystal capacitances CLC and the auxiliary capacitances CS. However, as shown in FIG. 9, the applied charges decrease due to leakage currents form the pixel transistors and the auxiliary capacitances CS, so that the absolute voltage Vp of the liquid crystal application voltage Vp decreases.

In case where the thin film transistor is used as a switching element as described above, it is known that there appears a phenomenon that the liquid crystal application voltage Vp decreases only by ΔV at the timing when the scanning signal VG drops, i.e., at the timing when the pixel transistor TFT switches from ON-status to OFF-status, as shown in FIG. 9. This is caused by the influence from a parasitic capacitance CGS between the gate electrode G and the source electrode S of the pixel transistor TFT, because the voltage change ΔVg when the scanning signal VG drops changes the potential of the pixel electrode through the parasitic capacitance CGS. This is called a field-through phenomenon, and the ΔV is called a field-through voltage. The field-through voltage ΔV is generally expressed by the next expression.

$$\Delta V = CGS \times \Delta Vg / (CGS + CLC + CS) \quad (1)$$

As shown in FIG. 9, the field-through voltage ΔV is constantly generated in the negative-polarity direction, so that a direct current voltage component is generated in the liquid crystal application voltage Vp due to the difference in the positive-negative voltage from the common electrode voltage Vcom. This component is applied to the liquid crystal. In this manner, drawbacks are caused, i.e., flickering and seizing phenomena occur inviting deterioration of display quality, and deterioration of liquid crystal is accelerated resulting in lower reliability concerning the liquid crystal display device. The direct current voltage component is substantially the value of about the field-through voltage ΔV.

Conventionally, to restrict these drawbacks, the method as follows is adopted. That is, as shown in FIG. 9, the common electrode voltage Vcom is corrected by a voltage (offset voltage: about ?ΔV) which cancels the direct current voltage component, so that the positive and negative voltages are equalized substantially with respect to the common electrode voltage Vcom of the liquid crystal application voltage Vp, thereby to restrict the influence from the field-through voltage ΔV.

The liquid crystal capacitance CLC is not a constant value and has a characteristic that it changes on the basis of the voltage applied to the liquid crystal. This is based on dielectric anisotropy of liquid crystal. FIG. 10 is a graph showing an example of change characteristic of the dielectric constant (relative dielectric constant) of liquid crystal with respect to the applied voltage. From this graph, it can be understood that the dielectric constant of liquid crystal increases so that the liquid crystal capacitance CLC increases, when the applied voltage is high, while the dielectric constant decreases so that the liquid crystal capacitance CLC decreases, when the applied voltage is low or in a state where no voltage is applied. Hence, based on the expression (1), the field-through voltage ΔV changes in accordance with the display signal voltage Vsig applied to the pixel electrode. In a state where the applied voltage is low, the field-through voltage ΔV increases, while the field-through voltage ΔV decreases in a state where the applied voltage is high.

Conventionally, the response of liquid crystal to the applied voltage is slow, and therefore, the capacitance value of liquid crystal at the time when the scanning signal VG drops substantially corresponds to the display signal voltage applied during a just preceding field period.

Therefore, change of the liquid crystal application voltage Vp due to the field-through voltage ΔV cannot be excellently cancelled over the entire change range of the display signal voltage Vsig, to restrict sufficiently the influence thereof, only by the method of correcting the common electrode voltage Vcom by a constant offset voltage, as shown in FIG. 9.

Hence, conventionally, the value of the field-through voltage ΔV is decreased by setting the value of the auxiliary capacitance CS to be large to some extent, thereby to change of the field-through voltage ΔV due to change of the liquid crystal capacitance CLC within the change range of the display signal voltage Vsig. In this manner, deterioration of display quality is restricted. However, the auxiliary capacitance electrode ES forming part of the auxiliary capacitance CS is formed by using a process of forming gate electrode of the pixel transistor TFT, and is formed of an opaque metal layer such as aluminum or the like which is adopted to the gate electrode and the like. Therefore, the forming area of the auxiliary capacitance CS is an area which shuts off transmission of light. Therefore, if the auxiliary capacitance CS is set to be large, i.e., if the area of the auxiliary capacitance electrodes ES is set to be large, there is a problem that the area which shuts off light increases, so that the aperture ratio of the display pixels of the liquid crystal display panel decreases, thereby deteriorating the display quality and increasing the power consumption of the backlight source to attain predetermined luminance.

BRIEF SUMMARY OF THE INVENTION

The present invention has an advantage in that voltage change due to a field-through voltage is constantly cancelled so that excellent display quality is attained in a liquid crystal display device of an active matrix type.

Also, the present invention has an advantage in that auxiliary capacitances in display pixels can be eliminated so that the opening ratio of a liquid crystal display panel can be increased.

Further, the device according to the present invention has an advantage in that influences between signal application periods of respective colors are eliminated so that excellent display can be attained where it is applied to field-sequential driving.

To achieve the above advantages, a liquid crystal display device according to the present invention comprises: a liquid crystal display panel having a plurality of signal lines, a plurality of scanning lines, and a plurality of display pixels arrayed in a matrix and provided respectively near cross-points between the signal lines and the scanning lines through switching elements; and a driver which supplies the plurality of signal lines with a display signal in a field period, and which scans the plurality of scanning lines, to apply the display signal to the plurality of display pixels, wherein the driver applies a predetermined initialization signal voltage to the display pixels in at least one signal application period set within the field period, and which thereafter applies the display signal. In this case, the switching elements may be thin film transistors, and the value of the initialization signal voltage may be set to a value equal to or higher than the maximum value of the display signal.

The driver may be structured so as to apply the initialization signal voltage to the display pixels and to thereafter apply the display signal after a predetermined hold time, in the signal application period, and the hold time is set to a time equal to or longer than a voltage-write response time of the display pixels. Also, in the signal application period, the initialization signal voltage and the display signal may be applied to the display pixels connected to the scanning lines, sequentially for every one of the scanning lines, at a time interval at which timings of applying the initialization signal voltage and the display signal do not overlap each other. Alternatively, in the signal application period, application timing may be set such that the initialization signal voltage is applied simultaneously to all the display pixels of the liquid crystal display panel, and thereafter the display signal is applied to the display pixels connected to the scanning lines of the liquid crystal display panel, at a predetermined time interval, sequentially for every one of the scanning lines. As a result of this, the liquid crystal capacitances of the display pixels at the falling time of the gate pulse can be set to be substantially constant by application of the initialization signal voltage, so that the change amount of the voltage applied to liquid crystal due to the field-through voltage can be set to be substantially constant and can always be cancelled by adjusting the common electrode voltage. In addition, it is unnecessary to decrease the field-through voltage. Therefore, the auxiliary capacitance provided for the display pixels can be extremely small or eliminated.

In addition, this driver may be applied to field-sequential driving. In this case, three signal application periods are provided in one field period. In each signal application period, the initialization signal voltage is applied, and thereafter, any one of the first (red), second (green), and third (blue) color component signals is applied to the display pixels connected to the scanning lines, sequentially for every one of the scanning lines. Further, an illumination light source capable of controlling light emission color is controlled to have light emission color corresponding to the color component signals applied respectively in the signal application periods. In this manner, the display signal voltage to be written into the display pixels can be once reset for every signal application period, so that influence from a preceding signal application periods can be eliminated.

To achieve the above advantages, a drive control method according to the present invention for a liquid crystal display device comprises: providing at least one signal application period in the field period; applying a predetermined initialization signal voltage to display pixels in the signal application period; and applying a display signal to display pixels after completion of the applying of the initialization signal voltage. Also, the drive control method further comprises providing of a predetermined voltage hold time after completion of the applying of the initialization signal voltage to the display pixels, and applying the display signal to the display pixels after the voltage hold time has passed after the applying of the initialization signal voltage. Further, the applying of the initialization signal voltage includes applying the initialization signal voltage to the display pixels connected to the scanning lines, sequentially for every one of the scanning lines, or includes applying the initialization signal voltage simultaneously to all the display pixels connected to the scanning lines. The applying of the display signal includes applying the display signal to the display pixels connected to the scanning lines, sequentially for every one of the scanning lines.

In case where this drive control method is applied to field-sequential driving, the method comprises providing three signal application periods in one field period, applying the initialization signal voltage simultaneously to the plurality of display pixels connected to the scanning lines in each of the signal application periods, and applying any of the first (red), second (green), and third (blue) color component signals, to the display pixels connected to the scanning lines, sequentially for every one of the scanning lines. Further, in each of the signal application periods, controlling of light emission color of an illumination light source capable of the light emission color includes controlling the light emission color so as to correspond to any of the respective color component signals that is applied to the display pixels.

BRIEF DESCRIPTION OF THE SEVERAL VIEWS OF THE DRAWING

FIG. 4 shows a table indicating measured values of the response characteristic with reference to the cell gap of liquid crystal;

DETAILED DESCRIPTION OF THE INVENTION

Figure 1:
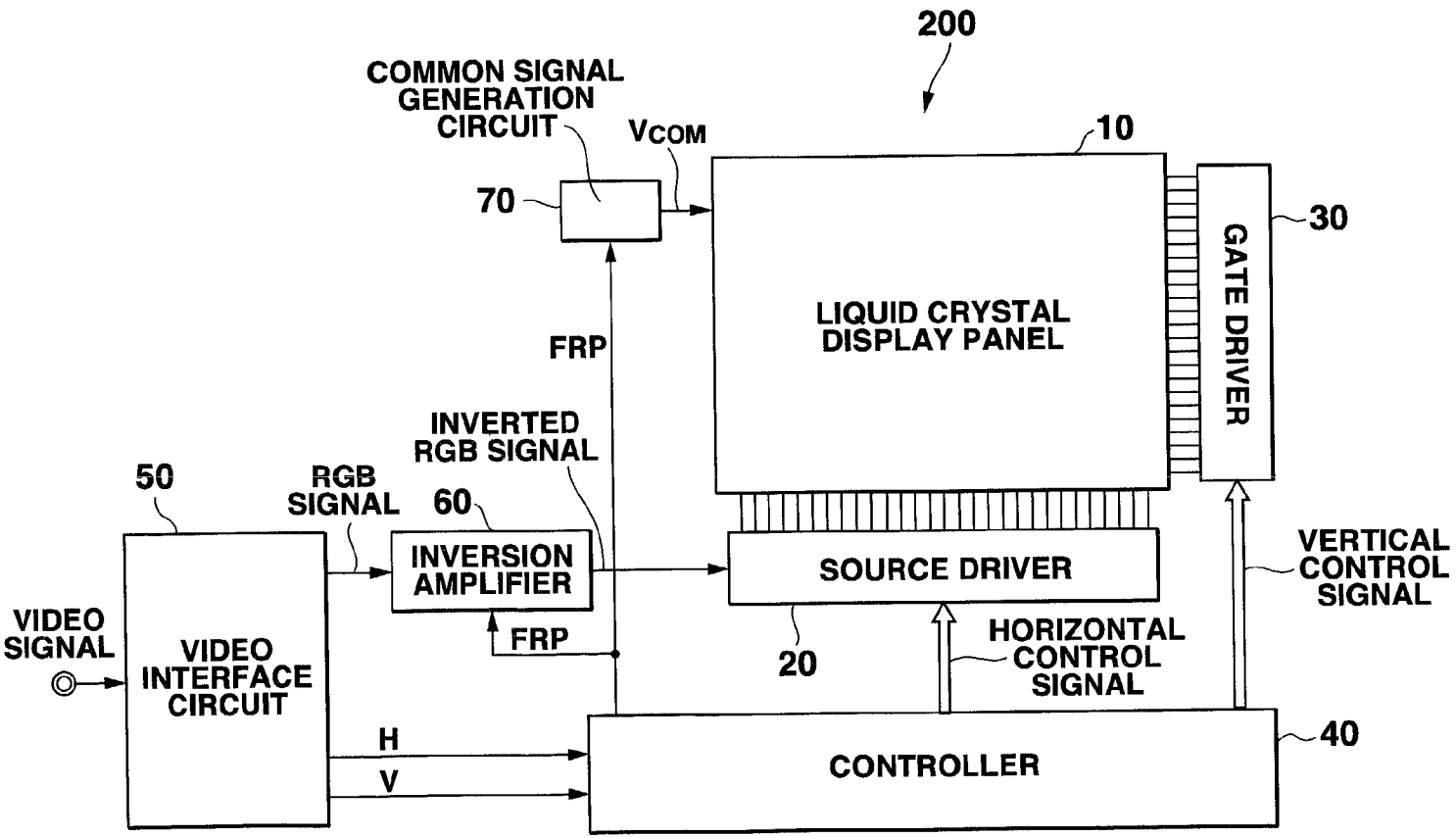
FIG. 1 is a block diagram showing a structural example of a liquid crystal display device according to a first embodiment of the present invention.

In the following, a liquid crystal display device and a drive control method thereof according to the present invention will be explained in details on the basis of embodiments shown in the drawings.

FIRST EMBODIMENT

FIG. 1 is a block diagram showing a structural example of a liquid crystal display device according to the first embodiment of the present invention. For conveniences, explanation will be made appropriately referring to the structure of a liquid crystal display panel 100 shown in FIG. 8A.

As shown in FIG. 1, a liquid crystal display device 200 has a liquid crystal display panel 10, a source driver 20, a gate driver 30, a controller 40, a video interface circuit 50, an inversion amplifier 60, and a common signal generation circuit 70, where it is roughly classified.

The structure of each component will now be explained.

The liquid crystal display panel 10 comprises a plurality of scanning lines GL extended in the row direction of the liquid crystal display panel, a plurality of signal lines DL extended in the column direction, pixel transistors TFT provided respectively near the cross-points between the signal lines DL and the scanning lines GL, pixel electrodes connected to source electrodes S of the pixel transistors TFT, liquid crystal capacitances CLC opposed to the pixel electrodes and made of liquid crystal filled between common electrodes connected in common to serve as display electrodes, and auxiliary capacitances CS having auxiliary capacitance electrodes ES opposed to the pixel electrodes and connected in common to each other. The pixel transistor TFT has a drain electrode D connected to a signal line DL and a gate electrode G connected to a scanning line GL. As will be described later, the liquid crystal display panel 10 is capable of extremely downsizing or eliminating the auxiliary capacitances CS.

The source driver 20 has such a structure that it receives a display signal voltage Vsig made of an inverted RGB signal corresponding to a video signal supplied from the video interface circuit 50 through the inversion amplifier 60, and supplies this display signal voltage Vsig, to each of the signal lines DL of the liquid crystal display panel 10, based on the horizontal control signal supplied from the controller 40 described later. In the present embodiment, the source driver 20 is further characterized in the function to supply an initialization signal voltage having a voltage value equal to or greater than the maximum voltage value of the display signal voltage Vsig, to the respective pixel electrodes through the signal lines DL and to thereafter supply the display signal voltage Vsig at predetermined timing. Used normally as a display mode of the liquid crystal display panel 10 is a normally white mode in which the permeability is high so the display is bright when the voltage supplied to the pixel electrodes is low, and the permeability decreases and the display is darkened as the voltage increases. Therefore, when a high initialization signal voltage having a voltage value equal to or greater than the maximum voltage value of the display signal voltage Vsig is supplied to the pixel electrodes, the display mode is black display. Hence, the initialization signal voltage having a high voltage value, which is applied prior to supply of the display signal voltage Vsig is hereinafter called "black signal voltage Vmax".

The gate driver 30 sequentially applies the scanning signal Vg to the respective scanning lines GL of the liquid crystal display panel 10, based on the vertical control signal supplied from the controller 40. In this manner, the pixel transistors TFT are sequentially brought into selected status for every scanning line GL connected thereto, and the black signal voltage Vmax supplied to the signal lines DL and the display signal voltage Vsig are supplied for every pixel electrode connected to the selected pixel transistors TFT.

The controller 40 generates a horizontal control signal and a vertical control signal, based on a horizontal synchronization signal H and a vertical synchronization signal V supplied from the video interface circuit 50, and supplies them to each of the data driver 20 and the gate driver 30. The controller 40 also generates an inverted control signal FRP for inverting and driving the liquid crystal display panel 10, and supplies it to the inversion amplifier 60 and the common signal generation circuit 70. With use of these signals, the controller 40 performs control of applying the black signal voltage Vmax and the display signal voltage Vsig to the pixel electrodes at predetermined timing, thereby to display desired image information on the liquid crystal display panel 10.

The video interface circuit 50 is inputted with a video signal and performs synchronous separation detection on the video signal or performs chroma processing or the like by extracting a burst signal in correspondence with a timing control signal (omitted from the drawings) from on the controller 40, thereby to extract an RGB signal forming three-primary color signals of R, G, and B, the horizontal synchronization signal H, and the vertical synchronization signal V. The video interface circuit 50 then outputs the RGB signal to the inversion amplifier 60 as well as the synchronization signals H and V to the controller 40.

The inversion amplifier 60 is supplied with the RGB signal from the video interface circuit 50. The inversion amplifier 60 generates an inverted RGB signal, based on the inversion control signal FRP supplied from the controller 40, and supplies it to the source driver 20.

The common signal generation circuit generates a common electrode voltage Vcom, based on the inversion control signal FRP supplied from the controller 40, and supplies it to the common electrodes COM and the auxiliary capacitance electrodes ES of the liquid crystal display panel 10.

In the structure as described above, the source driver 20 is supplied with a display signal voltage Vsig made of an analogue inverted RGB signal, and comprises an analogue driver circuit. However, the present invention is not limited thereto. For example, a source driver of a digital system may be used and an A/D conversion circuit may be comprised, so that the analogue RGB signal supplied from the video interface circuit may be supplied to the source driver of the digital system.

Next, the drive control method for the liquid crystal display device in the first embodiment according to the present invention will be explained with reference to the drawings.

Figures 2A, 2B, 2C:
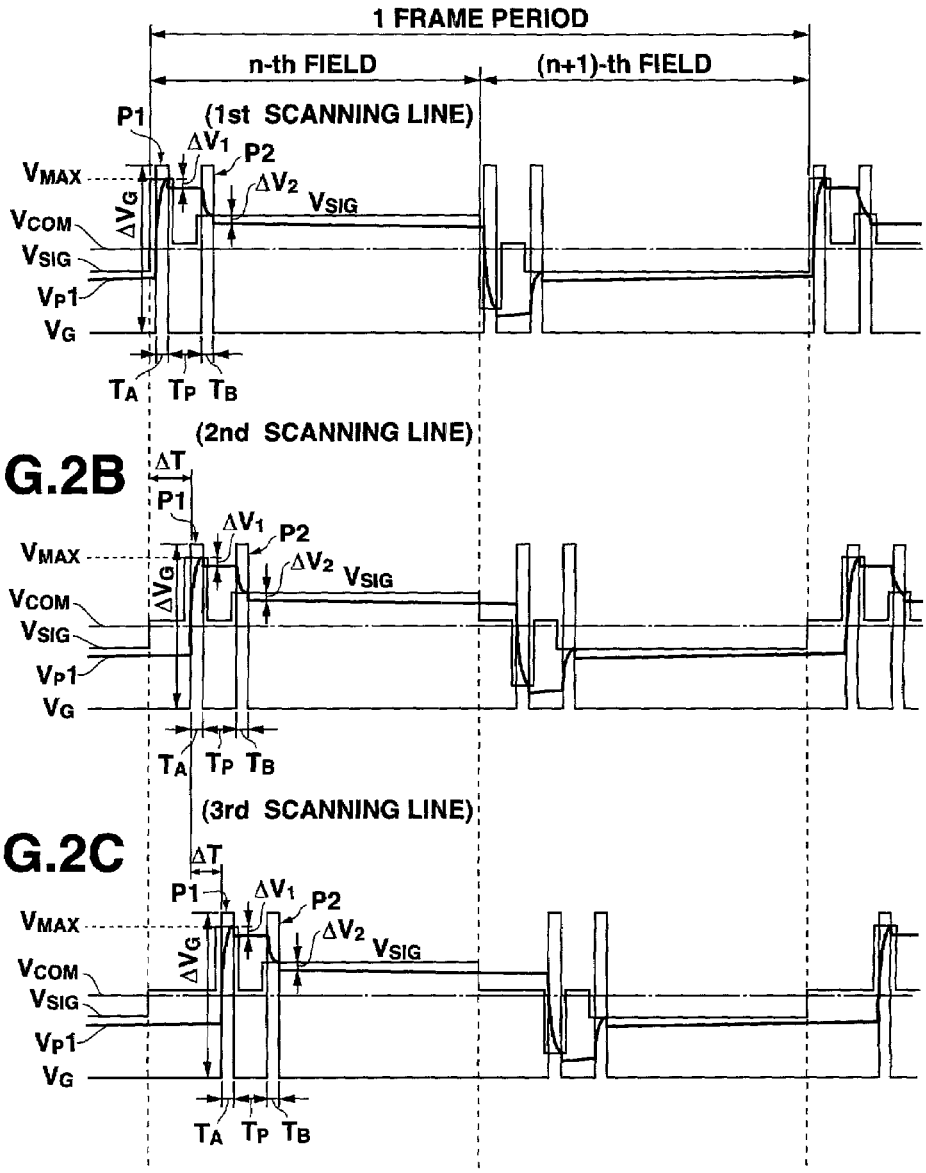
FIGS. 2A to 2C are timing charts showing a drive control method for the liquid crystal display device according to the first embodiment of the present invention.

FIGS. 2A to 2C are timing charts showing the drive control method for the liquid crystal display device according to the first embodiment of the present invention. Explanation will now be made with reference to the structure of the liquid crystal display device shown in FIG. 1.

In the present embodiment, for example, the number of scanning lines GL provided for the liquid crystal display panel is set to 220, and one field period (about 16.7 ms) is used as a signal application period. Drive control is performed such that the black signal voltage Vmax described above and the display signal voltage Vsig are applied to the display pixels for every signal application period, with their polarities inverted. In the timing charts shown in FIGS. 2A to 2C, the common electrode drive voltage Vcom is shown as a constant voltage to simplify the explanation. Needless to say, however, this voltage Vcom may be controlled and inverted in correspondence with inversion of the display signal voltage.

As shown in FIGS. 2A to 2C, the drive control method according to the present embodiment applies the drive control sequence described below to each scanning line at a predetermined timing interval. For conveniences for explanation, the drive control sequence in one scanning line will be explained at first.

As shown in FIG. 2A, in the drive control method according to the present embodiment, at first, each of the signal lines DL of the liquid crystal display panel 10 is supplied with the black signal voltage Vmax at predetermined timing for every field period, by the source driver 20.

Next, at predetermined timing during a period for which the black signal voltage Vmax is supplied to each signal line DL, the gate driver 30 applies a first gate pulse P1 to the first scanning line GL of the liquid crystal display panel 10 by the scanning signal VG. As a result, the gate electrodes G of the pixel transistors TFT connected to this scanning line GL are applied with the first gate pulse P1 and are brought into ON-status, so that the black signal voltage Vmax applied to each signal line DL is applied to and written into the liquid crystal capacitances CLC. The write time Ta taken for writing into the liquid crystal capacitances CLC, which corresponds to the pulse width of the first gate pulse P1, is set to, for example, 30 μsec based on the number of scanning lines.

Next, after completion of writing the black signal voltage Vmax, each display pixel is maintained for a predetermined hold period Tp with the black signal voltage Vmax kept written therein. This hold time Tp is set to a time equal to or longer than the response time of used liquid crystal, e.g., about 1 ms. This liquid crystal response time expresses the time required from when a voltage is applied to liquid crystal to when the liquid crystal shifts to an oriented state corresponding to the voltage. Detailed explanation thereof will be made later. In this manner, the oriented state of the liquid crystal capacitances CLC into which the black signal voltage Vmax has been written comes to be a state substantially corresponding to the black signal voltage Vmax. While the black signal voltage Vmax is held, the screen display is black and the screen is thus darkened. Therefore, it is not preferred to extend the hold time Tp than required. It is hence preferred to set the hold time Tp to a necessary shortest time.

Also, as shown in FIG. 2A, immediately after completion of application of the first gate pulse P1 to the scanning lines GL, the liquid crystal application voltage Vp1 decreases by a field-through voltage ΔV1 based on the expression (1) described previously, due to the field-through phenomenon. As has been described previously, the dielectric rate of liquid crystal has a characteristic that it increases as the voltage applied to the liquid crystal increases. In addition, the liquid crystal response time is shortened and writing becomes faster as the applied voltage increases. Therefore, at the time point when application of the first gate pulse P1 is completed, liquid crystal between the pixel electrodes and the common electrodes COM is brought into a state substantially corresponding to the black signal voltage Vmax, independently from the display signal voltage Vsig in the immediately preceding field period, so that the liquid crystal capacitances CLC increase. Accordingly, the field-through voltage ΔV1 is a relatively small value which is substantially constant, after applying the black signal voltage Vmax.

Next, the source driver 20 supplies each signal line DL with the display signal voltage Vsig corresponding to a video signal to be displayed on the liquid crystal display panel 10, at predetermined timing. Further, at predetermined timing during the period in which each signal line DL is supplied with the display signal voltage Vsig, the gate driver 30 applies a second gate pulse P2 to the first scanning line GL by the scanning signal Vg. In this manner, the gate electrodes G of the pixel transistors TFT connected to this scanning line GL are applied with the second gate pulse P2 and are brought into ON-status, so that the display signal voltage applied to each signal line DL is applied to and written into each liquid crystal capacitance CLC through the pixel electrodes connected to the pixel transistors TFT. Therefore, immediately after completion of application of the second gate pulse P2 to the scanning line GL, the liquid crystal application voltage Vp1 decreases by a field-through voltage ΔV2 based on the expression (1) described previously, due to the field-through phenomenon. As has been described previously, the liquid crystal capacitances CLC immediately after completion of application of the second gate pulse P2 is a substantially constant value corresponding to the black signal voltage Vmax, independently from the display signal voltage Vsig. Accordingly, the field-through voltage ΔV2 is a relatively small value which is substantially constant regardless of the display signal voltage Vsig.

Therefore, the values of the field-through voltages ΔV1 and ΔV2 are substantially constant values, independently from the values of the display signal voltage Vsig in the field period and the display signal voltage Vsig applied to the immediately preceding field period. Accordingly, by setting the common electrode voltage Vcom to a voltage which cancels the field-through voltages ΔV1 and ΔV2 in correspondence with these voltagesΔV1 and ΔV2, the positive-negative asymmetry of the pixel electrode potential can be excellently cancelled or reduced to e very small, independently from the value of the display signal voltage Vsig.

The drive control sequence in one scanning line as explained above is also adopted to every scanning line, in the order of the second scanning line to the third scanning line, as shown in FIGS. 2A to 2C, at timing at which the gate pulses applied to the scanning lines do not overlap each other. In this manner, all the display pixels of the liquid crystal display panel 10 can be driven.

In this manner, it is possible to reduce flicker and seizure phenomena to improve the display quality, and to reduce deterioration of liquid crystal to improve the reliability of the liquid crystal display device.

In the conventional apparatus, auxiliary capacitances CS provided in parallel with the liquid crystal capacitances CLC are enlarged to some extent and the value of the field-through voltage ΔV is reduced, as described previously. However, according to the present embodiment, the positive-negative asymmetry of the pixel electrode potential can be cancelled excellently by adjusting the common electrode voltage Vcom, independently from the size of the field-through voltage ΔV. Therefore, the auxiliary capacitances CS may be set to very small capacitances which are required only to hold voltages written or no auxiliary capacitance CS may be provided.

Figure 3:
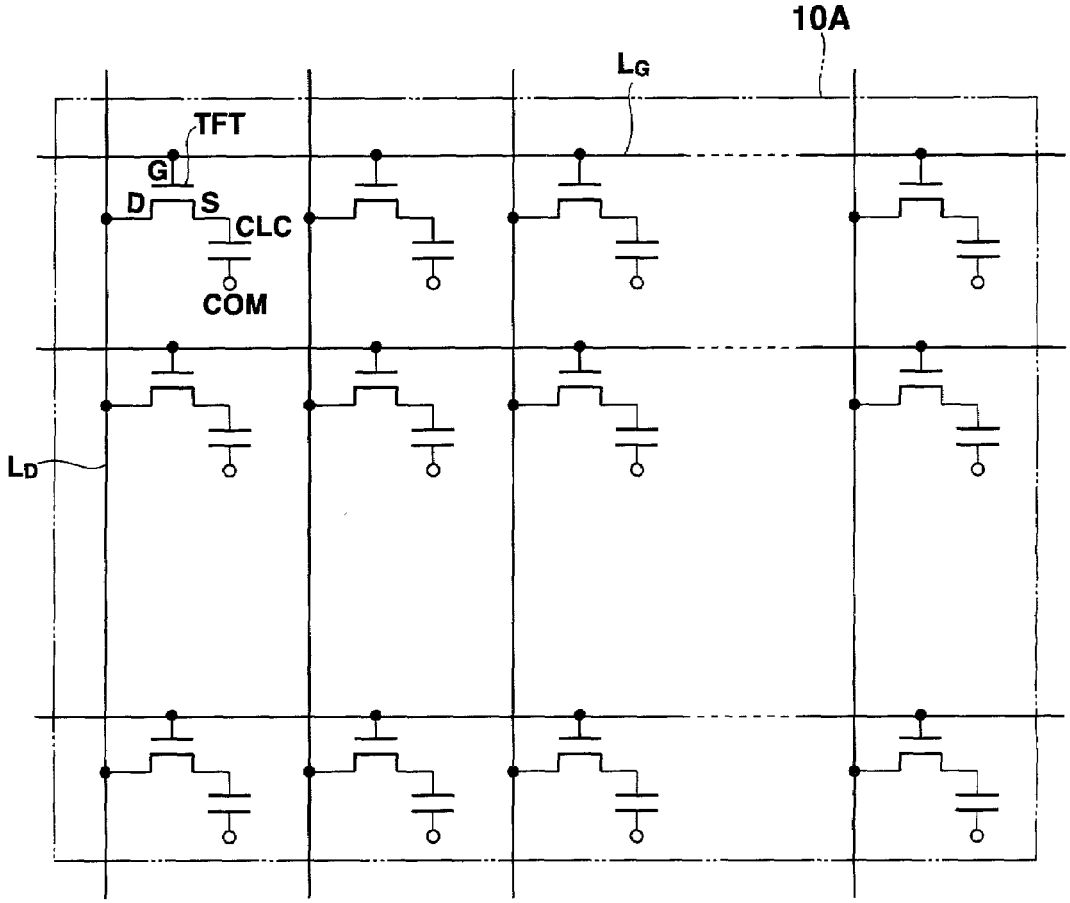
FIG. 3 is an equivalent circuit of a liquid crystal display panel, which is applicable to a liquid crystal display panel of the liquid crystal display device according to the present invention and which does not has a auxiliary capacitance.

FIG. 3 shows an equivalent circuit of a liquid crystal display panel which can be applied to the liquid crystal display panel of the present invention and does not have a auxiliary capacitance. In case of this liquid crystal display panel 10A which does not have a auxiliary capacitance CS, the positive-negative asymmetry of the pixel electrode potential can be substantially cancelled by only adjusting the common electrode voltage Vcom, and therefore, excellent display quality can be obtained. In this case, it is possible to eliminate the area occupied by the auxiliary capacitances CS which are parts shutting off light in the display pixels. The aperture of each display pixel can be greatly improved. In this manner, the display quality can further be improved and the power consumption of the back light source can be reduced.

In this case, it is necessary to set the timing of applying the black signal voltage Vmax for each scanning line, the timing of applying the corresponding first gate pulse P1, the timing of applying the display signal voltage Vsig, and the timing of applying the corresponding gate pulse P2, so as not to overlap each other. Therefore, if the pulse widths of the first gate pulse P1 and the second gate pulse P2 are each 30 μs, for example, the interval ΔT between the first gate pulses P1 or the second gate pulses P2 for the respective scanning lines must be set to at least 60 μs.

In this case, the following expression can be obtained, supposing that the number of scanning lines GL is 220, one field period is 16.7 ms, and the maximum value of the hold time Tp is Tpmax.

$$60\ \mu s \times 220 + Tp\max = 16.7\ \text{ms}$$

Hence, the maximum value Tpmax of the hold time Tp is 3.5 ms.

In the drive method according to the first embodiment, the maximum value of the time which can be set as the hold time Tp is 3.5 ms where the number of scanning lines GL is 220 and the widths of the first and second gate pulses P1 and P2 are each 30 μs.

If the response time is shorter than 30 μs, for example, the orientation status of liquid crystal changes, following writing of the video signal voltage by the second gate pulse P2. As a result of this, the field-through voltage changes in accordance with the value of the video signal voltage. It is therefore not always preferred to adopt the structure in which the field-through voltage is set to be substantially constant independently from the video signal voltage, as described above. The minimum value of the response time hence must be greater than the pulse width of the second gate pulse P2 to some extent. Accordingly, the minimum value of a response time of usable liquid crystal is about 1 ms. Therefore, if the first embodiment is applied to the liquid crystal display panel constructed in the structure described above, liquid crystal having a response time of 1 to 3.5 ms can be used.

If the number of scanning lines GL differs and the pulse width of each gate pulse differs accordingly, the range of the response time of usable liquid crystal is appropriately set accordingly, needless to say.

The relationship between the cell gap of the above-described liquid crystal and the response characteristic will now be explained with reference to the relationship expression and the drawings.

FIG. 4 is a table showing measured values of the response characteristic in relation to the cell gap of liquid crystal.

The relationship between the cell gap of liquid crystal and the response time will be expressed by the next expressions.

$$\tau r=\eta\cdot d2/(\epsilon 0\cdot\epsilon r\cdot V2\text{-}K\cdot\pi 2) \quad (2)$$

$$\tau f=\eta\cdot d2/(K\cdot\pi 2) \quad (3)$$

Here, τr is a rising response time, τf is a falling response time, d is a cell gap, η is viscosity of liquid crystal material, ϵ0 is a dielectric constant in vacuum ϵr is a dielectric constant of liquid crystal, K is an elastic constant, and V is an applied voltage.

As is apparent from the expressions (1) and (2), the rising and falling response times are each proportional to square of the cell gap d. Therefore, the response time of liquid crystal can be adjusted and controlled by arbitrarily setting the cell gap. The response times can be shortened by reducing the cell gap.

Hence, the present inventors measured the rising response time τr and the falling response time τf by various experiments, to obtain results as shown in FIG. 4 with respect to predetermined liquid crystal. In these experiments, the rising and falling response times are times required for the light permeability to shift from 0% to 90% in accordance with change of orientation of liquid crystal molecules.

As is apparent from the results shown in FIG. 4, for example, in order to obtain a high-speed characteristic of rising response time of about 1 ms (0.73 ms in this table) in case of twist-nematic liquid crystal, the cell gap needs to be set to about 1.5 μm. In this manner, the embodiment described above can be realized excellently.

In addition, since the rising response time tends to be in inverse proportion to square of the applied voltage V and be shorter than the falling response time, writing can be performed at a higher speed by setting a higher voltage to be applied to the display pixels. Therefore, in writing of the black signal voltage Vmax as described above, writing can be completed more rapidly as the applied voltage is increased.

The response times of liquid crystal as described above depend greatly on the conditions and structure such as operation modes of liquid crystal, orientation of liquid crystal molecules, and the like. The present invention does not limit these setting conditions of liquid crystal but these conditions may be appropriately set in accordance with the specifications of the liquid crystal display device, needless to say.

SECOND EMBODIMENT

Next, a drive control method according to the second embodiment of a liquid crystal display device according to the present invention will be explained with reference to the drawings. The structure of the liquid crystal display device is the same as that of the liquid crystal display device 200 shown in FIG. 1. Explanation will now be made with reference to the structure of the liquid crystal display device 200 shown in FIG. 1 and the structure of the liquid crystal display panel 100 shown in FIG. 8A. Operations that are equivalent to those of the first embodiment described above will be explained with use of equal reference symbols.

The drive control method for the liquid crystal display device according to the present embodiment is characterized in that the black signal voltage Vmax described previously is applied simultaneously to all the display pixels of the liquid crystal display panel, at first, and thereafter, the display signal voltage Vsig is sequentially applied to the respective scanning lines at predetermined timing, in contrast to the first embodiment as described previously.

Like the first embodiment described previously, in the drive control method according to the present embodiment, the drive control is performed such that one field period is used as a signal application period and that the black signal voltage Vmax and the display signal voltage Vsig are applied to the display pixels with their polarities are inverted for every signal application period.

Figure 5A:
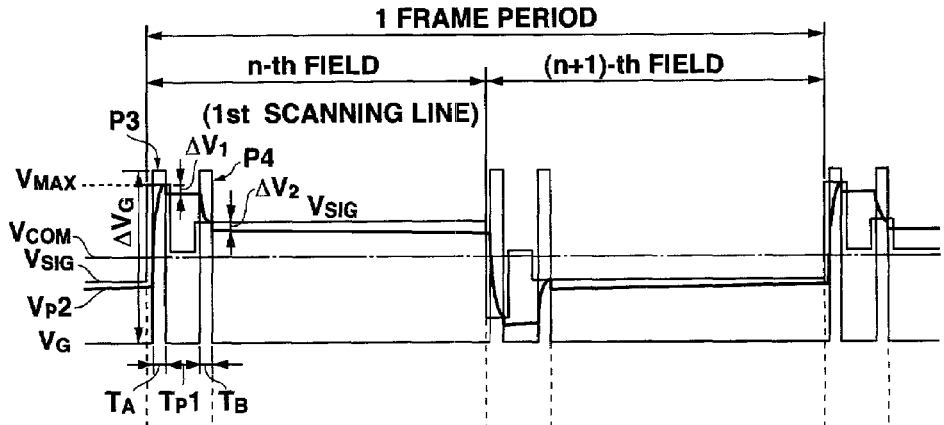
FIGS. 5A to 5C are timing charts showing a drive control method for a liquid crystal display device according to a second embodiment of the present invention.
Figure 5B:
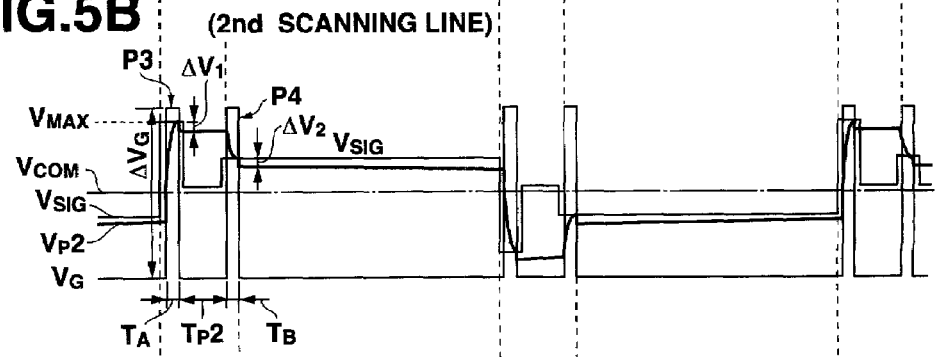
Figure 5C:
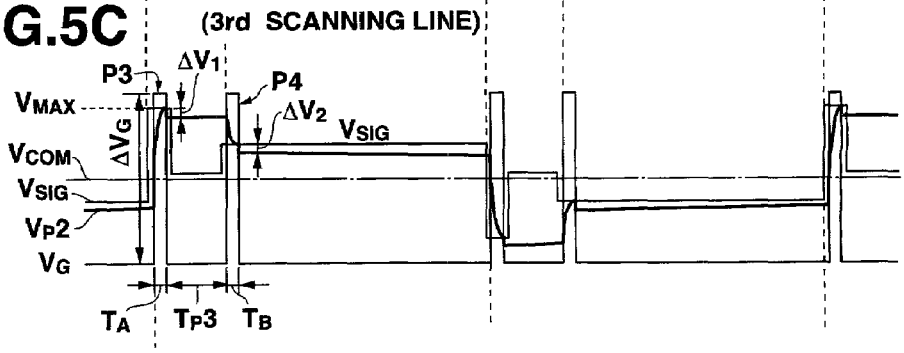

FIGS. 5A to 5C are timing charts showing the drive control method for the liquid crystal display device according to the second embodiment of the present invention. The explanation will now show a case where the common electrode voltage Vcom is set to a constant voltage.

As shown in FIGS. 5A to 5C, in the drive control method according to the present embodiment, the source driver 20 supplies the black signal voltage Vmax to each signal line DL of the liquid crystal display panel 10 at predetermined timing in each field period.

Next, the gate driver 30 applies a third gate pulse P3 simultaneously to all scanning lines GL at predetermined timing during the period in which the black signal voltage Vmax is supplied to each signal line DL. As a result, each of the gate electrodes G of the pixel transistors TFT connected to all the scanning lines GL, i.e., each of the gate electrodes G of all the pixel transistors TFT of the liquid crystal display panel 10 is applied with the gate pulse P3 and is thereby brought into ON-status, so that the black signal voltage Vmax applied to each signal line DL is simultaneously applied to and written into the liquid crystal capacitances CLC of all the pixel electrodes through the pixel electrodes. In this case, the write time Ta into the pixel electrode, which corresponds to the pulse width of the third gate pulse P3, is set to 30 μsec, for example.

Next, after completion of the black signal voltage Vmax, each display pixel is maintained in a state in which the black signal voltage Vmax is written, for a predetermined hold time for each scanning line GL. In the present embodiment, for example, the display pixels are maintained in this state for hold times Tp1, Tp2, Tp3, . . . (Tp1<Tp2<Tp3 . . . ) respectively in the order from the first scanning line GL. The shortest hold time Tp1 is set to a time equal to or longer than the response time of the used liquid crystal, e.g., about 1 ms. In this manner, the orientation status of liquid crystal is brought into a state substantially corresponding to the black signal voltage Vmax over all the display pixels.

Immediately after completion of application of the third gate pulse P3 to each scanning line GL, the liquid crystal application voltage Vp2 decreases by the field-through voltage ΔV due to the field-through phenomenon, like the first embodiment. This field-through voltage ΔV is a relatively small value which is substantially constant, as described previously.

Next, the source driver 20 supplies each signal line DL simultaneously with the display signal voltage Vsig corresponding to a video signal to be displayed on the liquid crystal display panel 10, at predetermined timing. Further, at predetermined timing during the period in which each signal line DL is supplied with the display signal voltage Vsig, i.e., after passing the hold times Tp1, Tp2, Tp3, . . . , the gate driver 30 applies a fourth gate pulse P4 to each scanning line GL. In this manner, the gate electrodes G are applied with the fourth gate pulse P4 and are brought into ON-status, for every of groups of pixel transistors TFT connected to the scanning lines GL, respectively, so that the display signal voltage Vsig applied to each signal line DL is applied to and written into liquid crystal capacitances CLC, for every of the groups of display pixels connected to the scanning lines GL, respectively.

In this case, the write time Tb taken for writing into the display pixels, which corresponds to the pulse width of the fourth gate pulse P4, is set to a very short time (e.g., about 30 μsec), compared with the liquid crystal response time, like the first embodiment. Therefore, the liquid crystal capacitances CLC when application of the fourth gate pulse P4 ends remain a value substantially corresponding to the black signal voltage Vmax, and thus always shows a substantially constant value. Therefore, the liquid crystal capacitances CLC are substantially constant as described above, although the liquid crystal application voltage Vp1 decreases by a field-through voltage ΔV2 due to the field-through phenomenon, immediately after application of the fourth gate pulse P4 to the scanning lines GL is completed. Accordingly, the value of the field-through voltage ΔV2 is substantially constant regardless of the display signal voltage Vsig.

According to the drive control operation of this kind of liquid crystal display device, at first, the high black signal voltage Vmax is applied to the display pixels and is maintained for predetermined hold times, thereby to set the orientation state of the liquid crystal of the display pixels into a state substantially corresponding to the black signal voltage Vmax, like the first embodiment. Thereafter, the display signal voltage Vsig is applied. By this structure, the liquid crystal capacitances CLC at the time point when the display signal voltage Vsig is written can always be maintained at a substantially constant value in a state when the value corresponding to the black signal voltage Vmax is maintained. Therefore, the field-through voltages ΔV1 and ΔV2, which are generated immediately after completion of application of the black signal voltage Vmax and the display signal voltage Vsig, can be set to be substantially constant. Accordingly, by setting the common electrode voltage Vcom to a voltage which cancels voltage changes caused by the field-through voltages ΔV1 and ΔV2, in correspondence with these voltagesΔV1 and ΔV2, the positive-negative asymmetry of the pixel electrode potential can be excellently cancelled or reduced to be very small, independently from the value of the display signal voltage Vsig.

In this manner, it is possible to reduce flicker and seizure phenomena to improve the display quality, and to reduce deterioration of liquid crystal to improve the reliability of the liquid crystal display device.

Also, like the first embodiment, the auxiliary capacitances CS provided in parallel with the liquid crystal capacitances CLC may be set to very small capacitances which are required only to hold voltages written or no auxiliary capacitance CS may be provided. As a result of this, the aperture of each display pixel can be greatly improved.

In this case, the hold times Tp1, Tp2, Tp3, . . . for respective scanning lines GL are set such that the write timings of the display signal voltage Vsig do no overlap between the scanning lines each other. That is, if the pulse width of the fourth gate pulse P4 is set to 30 μm, for example, the hold times are set to Tp1=1 ms, Tp2=1.03 ms, Tp3=1.06 ms, . . . . Alternatively, the hold times may be set to be equal to the timings for the respective fields. Alternatively, the order of the timings of the hold times for the respective scanning lines may be reversed for every field.

If the order of the timings of the hold times for the respective scanning lines may be reversed for every field, the black signal voltage Vmax and the display signal voltage Vsig are written for the hold time of the black signal voltage Vmax, for every scanning line GL in one frame-period, i.e., two field-periods. Thus, the time for which the image is displayed can be uniform, and the display luminance for every scanning line of the liquid crystal display panel 10 can be uniform, to improve the display quality.

The interval between gate pulses P4 for every scanning line can be set arbitrarily within a range in which the hold times required for writing the black signal voltage Vmax and the display signal voltage Vsig can be ensured.

In this case, if the number of scanning lines GL is 220, one field period is 16.7 ms, the pulse widths of the gate pulses P3 and P3 are each 30 μs, no interval is given between the gate pulses P4, and the maximum value of the hold time required for writing the black signal voltage Vmax and the display signal voltage Vsig is Tpmax, the following expression is given.

$$30\ \mu s+30\ \mu s\times 220+Tp1max\times 2=16.7\ ms$$

Hence, Tp1max of the hold time Tp is 5 ms. That is, in the drive method according to the second embodiment, the maximum value of the time which can be set as the hold time Tp1 is 5 ms where the number of scanning lines GL is 220 and the widths of the third and fourth gate pulses P3 and P4 are each 30 μs. In the present second embodiment, it is possible to use liquid crystal having a response time of 1 to 5 ms in case of the above structure.

Like the first embodiment, if the number of scanning lines GL differs and the pulse width of each gate pulse differs accordingly, the range of the response time of usable liquid crystal is appropriately set accordingly, needless to say.

Also, since the present embodiment performs control of applying the black signal voltage Vmax simultaneously to all the display pixels, it is not necessary to consider avoidance of overlapping of application timings of the display signal voltage Vsig and the black signal voltage Vmax. Therefore, limitations to setting of the application timing of the display signal voltage Vsig can be reduced.

THIRD EMBODIMENT

Next, the structure of a liquid crystal display device according to the third embodiment of the present invention and the drive control method thereof will be explained with reference to the drawings.

The first and second embodiments described above are structured such that the signal application period is set as one field period and the screen is overwritten for every one field period. In the third embodiment, however, one field period comprises three sub-field periods, and each of the sub-field periods corresponds to the signal application period in the embodiments described above. The present embodiment is characterized in that the sub-fields are set as periods for displaying red, green, and blue components of a video signal, and a drive control method similar to the second embodiment is adopted to perform field-sequential driving.

Figure 6:
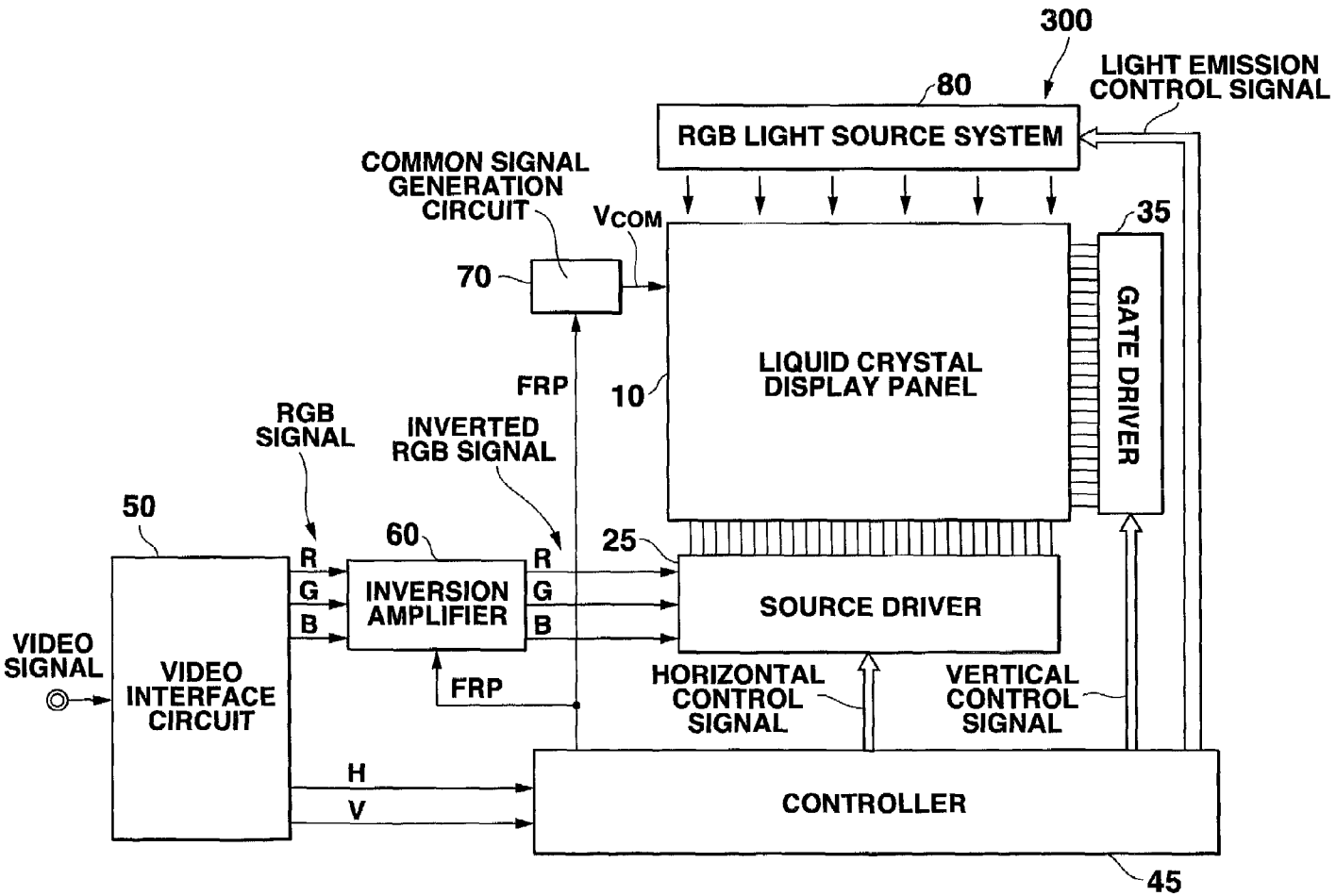
FIG. 6 is a block diagram showing a structural example of a liquid crystal display device according to a third embodiment of the present invention.

FIG. 6 is a block diagram showing a structural example of a liquid crystal display device according to the third embodiment of the present invention. Explanation will now be made with reference to the structure shown in FIG. 8A. The part of structure that is equivalent to the liquid crystal display device 200 in the first embodiment will be denoted at equal reference symbols, and explanation thereof will be simplified.

As shown in FIG. 6, a liquid crystal display device 300 according to the present embodiment has a liquid crystal display panel 15, a source driver 25, a gate driver 35, a controller 45, a video interface circuit 50, an inversion amplifier 60, and a common signal generation circuit 70, and also has an illumination light source or an RGB light source system 80.

Figure 8A:
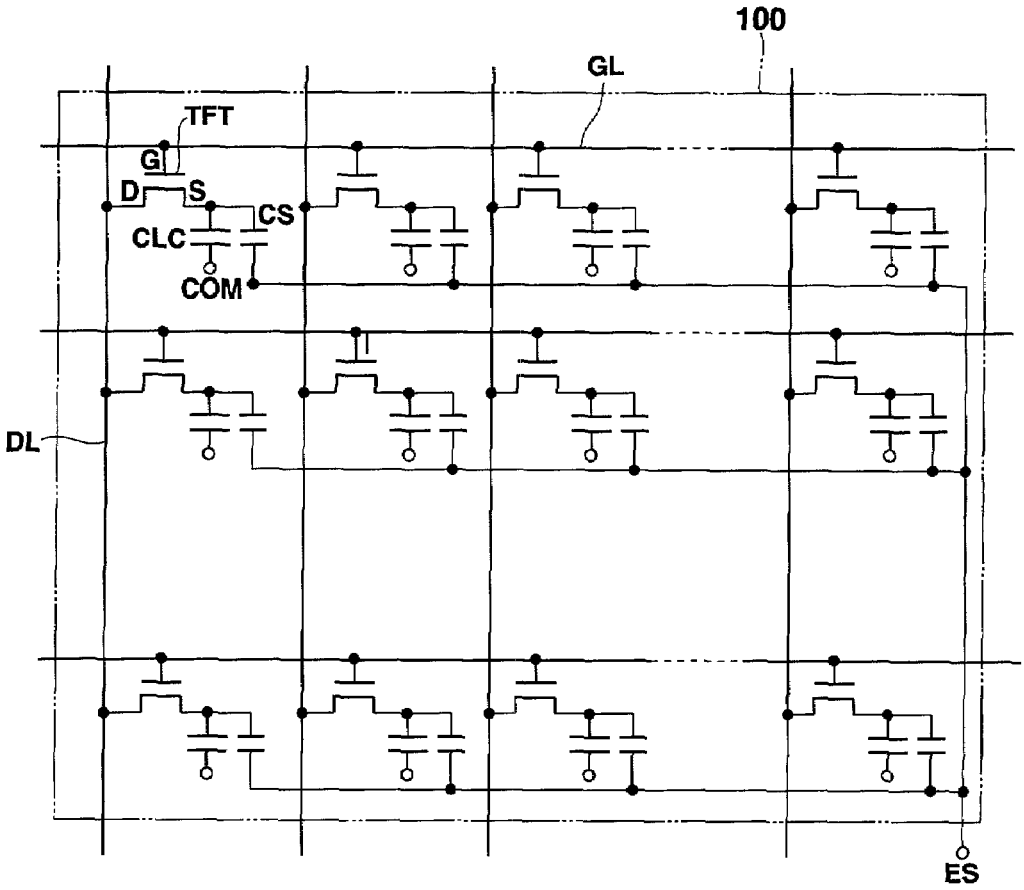
FIG.8A PRIOR ART
FIG. 8A shows an equivalent circuit of a conventional active-matrix-type liquid crystal display panel and FIG. 8B shows details of a display pixel part in the conventional active-matrix-type liquid crystal display panel.
Figure 8B:
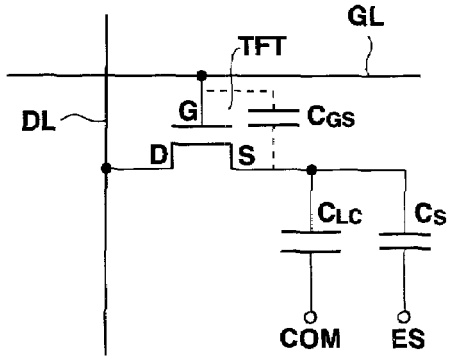
FIG.8B PRIOR ART
Figure 9:
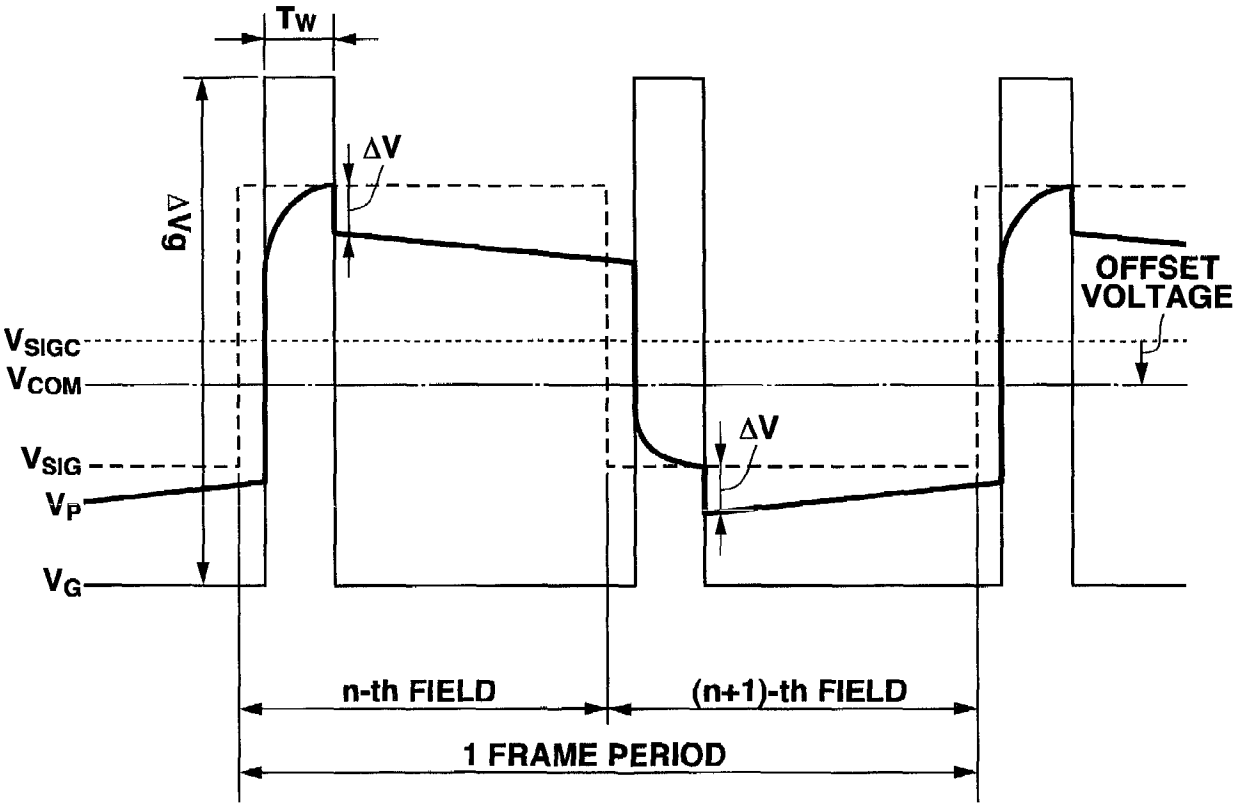
FIG.9 PRIOR ART
FIG. 9 is a timing chart showing operation of writing a display signal voltage into display pixels of the conventional active-matrix-type liquid crystal display panel.
Figure 10:
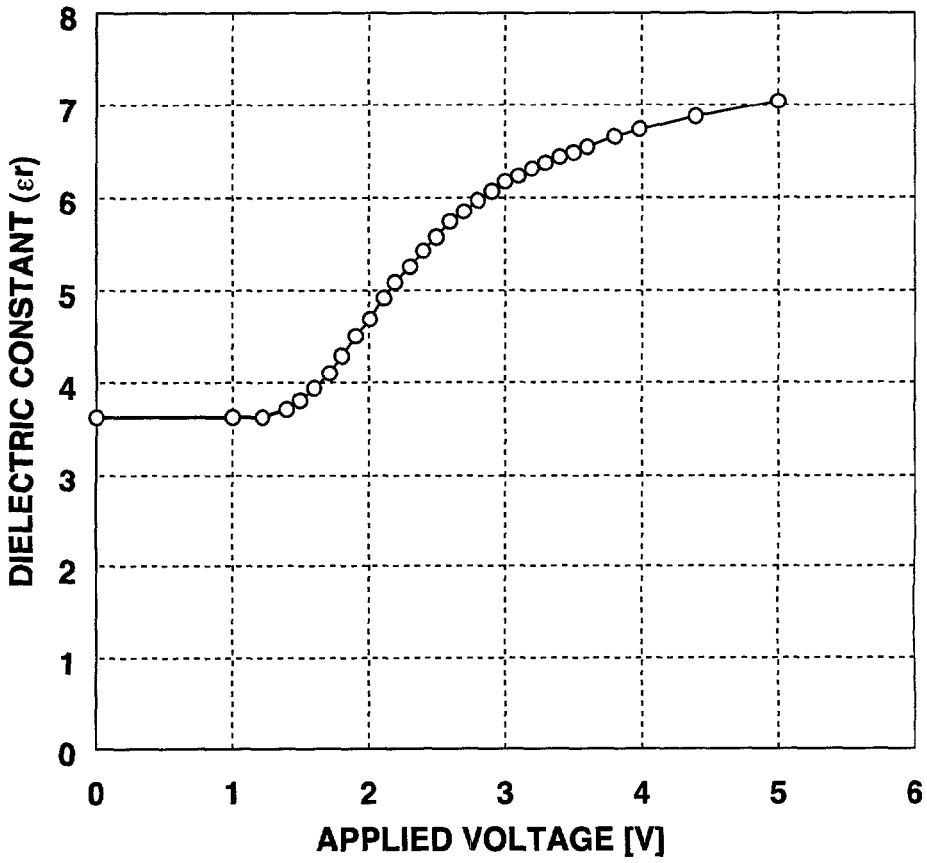
FIG.10 PRIOR ART
FIG. 10 is a graph showing an example of the change characteristic of the dielectric rate of liquid crystal in relation to an applied voltage.

Like the equivalent circuit shown in FIG. 8A, the liquid crystal display panel 15 comprises a plurality of scanning lines GL, a plurality of signal lines DL, pixel transistors TFT provided respectively near the cross-points between the signal lines DL and the scanning lines GL, pixel electrodes connected to source electrodes S of the pixel transistors TFT, common electrodes COM opposed to the pixel electrodes, liquid crystal capacitances CLC as display pixels, and auxiliary capacitances CS. However, since the present embodiment comprises a structure in which color display is achieved with use of RGB light by the illumination light source 80 as a back light, the liquid crystal display panel 15 is a monochrome-type panel which is not provided with a color filter. Alternatively, it is possible to adopt a structure which is not provided with the auxiliary capacitances, as shown in FIG. 3.

Like the source driver 20 in the liquid crystal display device 200, the source driver 25 has a structure that it receives a display signal voltage Vsig made of an inverted RGB signal supplied from the video interface circuit 50 through the inversion amplifier 60, and supplies the black signal voltage Vmax and the display signal voltage Vsig, to each of the signal lines DL of the liquid crystal display panel 15, based on the horizontal control signal supplied. In the present embodiment, however, the source driver 20 further has a structure for outputting first, second, and third color component signals of the inverted RGB signal, for every sub-field period, in order to achieve field-sequential driving which will be described later.

Like the gate driver 30 in the liquid crystal display device 200, the gate driver 35 has a structure for sequentially applying the scanning signal Vg to the respective scanning lines GL of the liquid crystal display panel 10, based on the vertical control signal. However, the gate driver in the present embodiment further has a structure for outputting a gate pulse, for every sub-field period, in order to achieve field-sequential driving which will be described later.

Like the controller 40 in the liquid crystal display device 200, the controller 45 has a structure for generating a horizontal control signal and a vertical control signal, based on a horizontal synchronization signal H, a vertical synchronization signal V, and the like supplied from the video interface circuit 55, and for supplying them to each of the data driver 20 and the gate driver 30. The controller 45 also has a structure for generating an inverted control signal FRP and for supplying it to the inversion amplifier 65 and the common signal generation circuit 70. In addition, the controller in the present embodiment further generates a horizontal control signal and a vertical control signal for performing the field-sequential driving which will be described later, and also generate and supplies a light emission control signal for controlling the light emission status of the illumination light source 80.

The video interface circuit 50 is the same as that of the liquid crystal display device 200. This circuit 50 extracts a RGB signal, the horizontal synchronization signal H, and the vertical synchronization signal V from an inputted composite video signal, and outputs the RGB signal to the inversion amplifier 60 as well as the synchronization signals H and V to the controller 44.

The inversion amplifier 60 is the same as that of the liquid crystal display device 200. This amplifier 60 generates a common electrode voltage Vcom, based on the inversion control signal FRP and supplies it to the common electrodes COM and the auxiliary capacitances ES of the liquid crystal display panel 10.

The illumination light source 80 serves as a back light of the liquid crystal display panel 15 and is supplied with the light emission control signal from the controller 45. The light source 80 emits light in red, green, and blue in correspondence with the light emission control signal.

Next, the drive control method for the liquid crystal display device according to the third embodiment of the present invention will be explained with reference to the drawings. In the drive control method according to the present embodiment, drive control is performed such that the polarities of the signal voltage applied to the display pixels are inverted for every one field period.

In the drive control method according to the present embodiment, one field period is divided into three sub-field periods of first to third sub-field periods, and field-sequential driving is performed using the sub-fields respectively as signal application periods for displaying the first, second, and third color component signals of the inverted RGB signal. For conveniences, explanation will be made supposing that the first, second, and third color component signals are respectively red, green, and blue signals.

FIGS. 7A to 7D are timing charts showing the drive control method for the liquid crystal display device in the third embodiment of the present invention. These figures show the case where the common electrode voltage Vcom is set to a constant voltage.

Figures 7A, 7B, 7C, 7D:
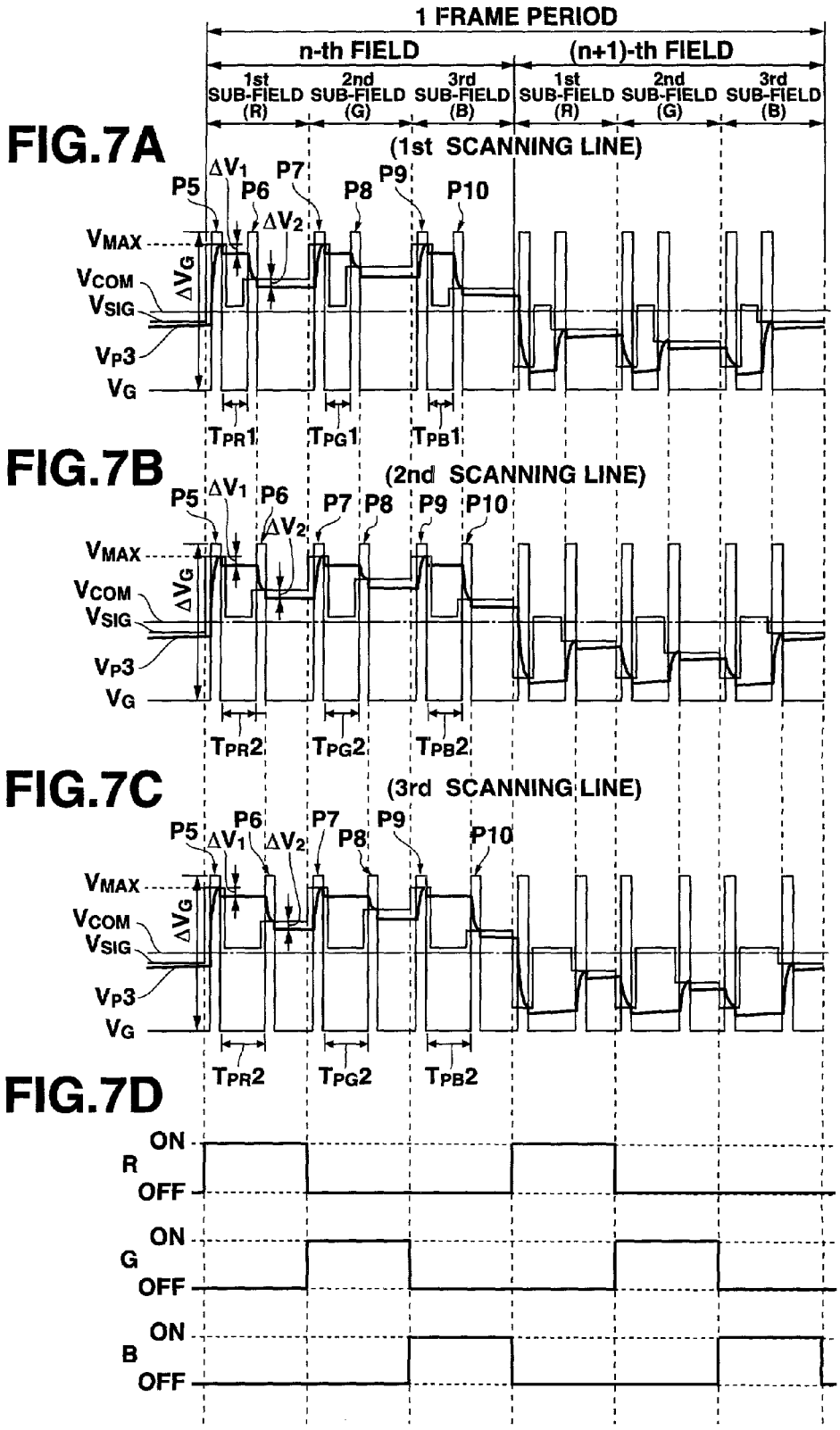
FIGS. 7A to 7D are timing charts showing a drive control method for the liquid crystal display device according to the third embodiment of the present invention.

As shown in FIGS. 7A to 7C, in the drive control method according to the present embodiment, the source driver 25 applies the black signal voltage Vmax to each signal line DL of the liquid crystal display panel 10 at predetermined timing in the first sub-field period.

Next, the gate driver 35 applies a fifth gate pulse P5 simultaneously to all scanning lines GL at predetermined timing during the period in which the black signal voltage Vmax is applied to each signal line DL. As a result, each of the gate electrodes G of all the pixel transistors TFT of the liquid crystal display panel 10 is applied with the fifth gate pulse P5 and is thereby brought into ON-status, so that the black signal voltage Vmax is simultaneously applied to and written into the liquid crystal capacitances CLC of all the display pixels.

Next, after completion of writing of the black signal voltage Vmax, the display pixels are maintained for predetermined hold times respectively for the scanning lines GL. In the present embodiment, for example, the display pixels are maintained in this state for hold times Tpr1, Tpr2, Tpr3, . . . respectively in the order from the first scanning line GL. The shortest hold time Tpr1 is set to a time equal to or longer than the response time of the used liquid crystal.

In this manner, the orientation status of liquid crystal is brought into a state substantially corresponding to the black signal voltage Vmax in all the display pixels.

Like the first embodiment, immediately after completion of application of the fifth gate pulse P5 to each scanning line GL, the liquid crystal application voltage Vp3 decreases by the field-through voltage ΔV1 due to the field-through phenomenon. This field-through voltage ΔV is a relatively small value and is substantially constant, as described previously.

Next, the source driver 25 supplies each signal line DL simultaneously with the red signal voltage of the inverted RGB signal supplied from the inversion amplifier 65, at predetermined timing. Further, at predetermined timing during the period in which each signal line DL is supplied with the red signal voltage, the gate driver 35 applies a sixth gate pulse P6 to each scanning line GL. In this manner, the gate electrodes G are applied with the sixth gate pulse P6 and are brought into ON-status, for every of groups of pixel transistors TFT respectively connected to the scanning lines GL, so that the red signal voltage is applied to and written into liquid crystal capacitances CLC, for every of the groups of display pixels respectively connected to the scanning lines GL.

In this case, like the first embodiment, the write time taken for writing into the display pixels, which corresponds to the pulse width of the sixth gate pulse P6, is set to a very short time, compared with the liquid crystal response time. Therefore, the liquid crystal capacitances CLC when application of the sixth gate pulse P6 is completed remain a value substantially corresponding to the black signal voltage Vmax, and thus always shows a substantially constant value. Therefore, although the liquid crystal application voltage Vp3 decreases by a field-through voltage ΔV2 due to the field-through phenomenon immediately after application of the sixth gate pulse P6 to the scanning lines GL is completed, the value of the field-through voltage ΔV2 is substantially constant regardless of the red signal voltage.

In addition, as shown in FIG. 7D, in the first sub-field period, a light emission control signal which turns on (allows light emission of) the light emission color (red) corresponding to the red signal is supplied to the illumination light source from the controller 45. As a result, the illumination light source 80 emits red light.

By the drive control described above, the red signal voltage is written into the display pixels and the red light is emitted from the illumination light source 80 thereby displaying red component of the video signal, in the first sub-field period.

Subsequently, in the second sub-field period, the green signal voltage is written into the display pixels and the green light is emitted from the illumination light source 80 thereby displaying green component of the video signal, like the first sub-field period.

That is, in the second sub-field period, the black signal voltage Vmax is supplied to each signal line DL, and a seventh gate pulse P7 is applied simultaneously to all scanning lines GL. As a result, the black signal voltage Vmax is simultaneously written into the liquid crystal capacitances CLC of all the display pixels. Next, after completion of writing of the black signal voltage Vmax, the display pixels are maintained for predetermined hold times respectively for the scanning lines GL, e.g., for hold times Tpg1, Tpg2, Tpg3, . . . respectively in the order from the first scanning line GL. Next, each signal line DL is simultaneously supplied with the green signal voltage of the inverted RGB signal. An eighth gate pulse P8 is applied sequentially to the scanning lines GL. In this manner, the green signal voltage is sequentially written into the liquid crystal capacitances CLC, for every of groups of display pixels respectively connected to the scanning lines GL. Also, in this second sub-field period, the illumination light source 80 is controlled to emit green light.

Subsequently, in the third sub-field period, the blue signal voltage is written into the display pixels and the blue light is emitted from the illumination light source 80 thereby displaying blue component of the video signal, like the first sub-field period.

That is, in the third sub-field period, the black signal voltage Vmax is supplied to each signal line DL, and a ninth gate pulse P9 is applied simultaneously to all the scanning lines GL. As a result, the black signal voltage Vmax is simultaneously written into the liquid crystal capacitances CLC of all the display pixels. Next, after completion of writing of the black signal voltage Vmax, the display pixels are maintained for predetermined hold times respectively for the scanning lines GL, e.g., for hold times Tpb1, Tpb2, Tpb3, . . . respectively in the order from the first scanning line GL. Next, each signal line DL is simultaneously supplied with the blue signal voltage of the inverted RGB signal. A tenth gate pulse P10 is applied sequentially to the scanning lines GL. In this manner, the blue signal voltage is sequentially written into the liquid crystal capacitances CLC, for every of groups of display pixels respectively connected to the scanning lines GL. Also, in this third sub-field period, the illumination light source 80 is controlled to emit blue light.

Since the drive control as described above is performed in the respective sub-field periods, the red, green, and blue components of the inverted RGB signal are displayed sequentially in one field period, so that field-sequential driving is realized.

In this field-sequential driving, it is necessary to switch the display signal voltage to be written into the display pixels, for every sub-field, without receiving influences from a preceding sub-field period. In this respect, according to the third embodiment described above, at first, the high black signal voltage Vmax is applied to all the display pixels of the liquid crystal display panel thereby to reset the write status of all the display pixels of an immediately preceding sub-field period. Therefore, writing of the display signal voltage into the display pixels can be switched excellently for every sub-field period. In this manner, excellent display can be obtained when the field-sequential driving is carried out.

In each of the embodiments described above, a high voltage having a voltage value equal to or higher than the maximum voltage of the display signal voltage is used as the signal voltage written prior to the video signal voltage. The present invention is not limited thereto. That is, a lower voltage (e.g., an intermediate voltage) can be applied as the signal voltage as long as changes of the liquid crystal capacitances can be reduced by applying the signal voltage, to make the field-through voltage substantially constant.

However, as described above, it is more preferable to apply a higher voltage to the display pixels. This is because the liquid crystal capacitances are increased, the field-through voltage is decreased, and the response time of liquid crystal is shortened, if a higher voltage is applied to the display pixels. Accordingly, the field-through voltage can be rendered substantially constant in a short time regardless of the magnitude of the video signal voltage applied in a preceding field.

Also, the present invention does not particular restrict the type of liquid crystal, orientation thereof, operation modes, and the like. As described previously, TN liquid crystal which is often used in a liquid crystal display device of a TFT active matrix type may be used, and the cell gap thereof may be set to about 1.5 μm, for example. The present invention can then be applied with realization of a high-speed response characteristic. Alternatively, the present invention is applicable to a liquid crystal display panel having a liquid crystal structure having homogeneous orientation which has a more excellent high-speed response characteristic than the TN liquid crystal, for example.

What is claimed is:

1. A liquid crystal display device comprising:

a liquid crystal display panel having a plurality of signal lines, a plurality of scanning lines, and a plurality of display pixels arrayed in a matrix and provided respectively near cross-points between the signal lines and the scanning lines through switching elements; and a driver which supplies the plurality of signal lines with a display signal in a field period, and which supplies the plurality of scanning lines with a scanning signal, to apply the display signal to the plurality of display pixels, wherein the driver includes means which supplies an initialization signal including a constant single pulse voltage to the plurality of signal lines and supplies a first gate pulse as the scanning signal to the display pixels, and after completing the supply of the initialization signal to the plurality of signal lines and completion of the supply of the first gate pulse to the plurality of scanning lines, and after a predetermined hold time, supplying the display signal to the plurality of signal lines and supplying a second gate pulse as the scanning signal to the plurality of scanning lines, thereby applying the display signal to the display pixel, at least one signal application period set within the field period, the liquid crystal display panel includes, a plurality of pixel electrodes arrayed in a matrix through the switching elements, common electrodes opposed to the pixel electrodes, and liquid crystal sandwiched between the pixel electrodes and the common electrode, and the hold time is set to a time equal to or longer than a voltage-write response time of the liquid crystal in the display pixels, wherein the initialization signal in the driver has a value equal to or higher than a maximum voltage value of the display signal.

2. The liquid crystal display device accordinq to claim 1, wherein the liquid crystal display panel is a non-auxiliary capacitance type.

3. The liquid crystal display device according to claim 1, wherein each of the switching elements of the liquid crystal display panel includes a thin film transistor.

4. The liquid crystal display device according to claim 1, wherein the driver applies the initialization signal and the display signal to the display pixels connected to the scanning lines of the liquid crystal display panel, at a predetermined time interval, sequentially for every one of the scanning lines, in the signal application period in the field period, and the time interval is set to a value at which timings of applying the initialization signal voltage and the display signal to every one of the display pixels connected to each of the scanning lines do not overlap with each other.

5. The liquid crystal display device according to claim 1, wherein application timing is set such that the driver applies the initialization signal simultaneously to all of the display pixels of the liquid crystal display panel, and thereafter applies the display signal to the display pixels connected to the scanning lines of the liquid crystal display panel, at a predetermined time interval, sequentially for every one of the scanning lines, in the signal application period in the field period.

6. The liquid crystal display device according to claim 1, wherein the driver provides three signal application periods in one field period.

7. The liquid crystal display device according to claim 6, wherein the display signal comprises first, second, and third color component signals, and the driver applies the initialization signal and thereafter applies any one of the first, second, and third color component signals, to the display pixels connected to the scanning lines of the liquid crystal display panel, sequentially for every one of the scanning lines, in each of the signal application periods of the field period.

8. The liquid crystal display device according to claim 7, further comprising an illumination light source capable of controlling light emission color, the illumination light source being controlled to have light emission color corresponding to any one of the first, second, and third color component signals that is applied by the driver in each signal application period.

9. The liquid crystal display device according to claim 6, wherein of the display signal, the first color component signal is a red component signal, the second color component signal is a green component signal, and the third color component signal is a blue component signal.

10. A drive control method for a liquid crystal display device which has a plurality of signal lines, a plurality of scanning lines, and a plurality of display pixels arrayed in a matrix and provided respectively near cross-points between the signal lines and the scanning lines through switching elements, the plurality of display pixels including a plurality of pixel electrodes arrayed in a matrix through the switching elements, common electrodes opposed to the pixel electrodes, and liquid crystal sandwiched between the pixel electrodes and the common electrode, wherein the plurality of signal lines are supplied with a display signal in a field period and scanning signals are supplied to the plurality of scanning lines, to apply the display signal to the plurality of display pixels, comprising:

providing at least one signal application period in the field period;

applying an initialization signal including a constant single pulse to the display pixels, by supplying the initialization signal to the plurality of signal lines and supplying a first gate pulse as the scanning signal to the scanning lines; and applying the display signal to the display pixels by supplying the display signal to the plurality of signal lines and supplying a second gate pulse as the scanning signal to the plurality of scanning lines after a predetermined voltage hold time has passed after completion of applying the initialization signal to the display pixels and the first gate pulse to the plurality of scanning lines, wherein the hold time is set to a time equal to or longer than a voltage-write response time of the crystal liquid in the display pixels, wherein the initialization signal has a value equal to or higher than a maximum voltage value of the display signal.

11. The drive control method according to claim 10, wherein applying the initialization signal includes applying the initialization signal to the display pixels connected to the scanning lines, sequentially for every one of the scanning lines, applying the display signal includes applying the display signal to the display pixels connected to the scanning lines, sequentially for every one of the scanning lines, and application timings of applying the initialization signal and the display signal for every one of the scanning lines are set so as not to overlap with each other.

12. The drive control method according to claim 10, wherein applying the initialization signal includes applying the initialization signal simultaneously to all display pixels connected to the scanning lines.

13. The drive control method according to claim 10, wherein providing the signal application period in the field period includes providing three signal application periods in one field period.

14. The drive control method according to claim 13, wherein the display signal comprises first, second, and third color component signals, and applying the initialization signal includes applying the initialization signal simultaneously to the plurality of display pixels connected to the scanning lines, in each of the signal application periods, and applying the display signal includes applying any of the first, second, and third color component signals, to the display pixels connected to the scanning lines, sequentially for every one of the scanning lines, in each of the signal application periods.

15. The drive control method according to claim 14, further comprising controlling light emission color of an illumination light source, wherein controlling of light emission color includes controlling the light emission color of the light source so as to correspond to any of the first, second, and third color component signals that is applied to the display pixels in applying the display signal.

* * * * *